US009062934B1

(12) United States Patent
Presley et al.

(10) Patent No.: US 9,062,934 B1
(45) Date of Patent: Jun. 23, 2015

(54) LOCKING ADJUSTER

(71) Applicant: TRIJICON, INC., Wixom, MI (US)

(72) Inventors: Michael Presley, Plymouth, MI (US); Rodney DeLaca, Canton, MI (US); Anthony Horvath, Temperance, MI (US)

(73) Assignee: Trijicon, Inc., Wixom, MI (US)

( * ) Notice: Subject to any disclaimer, the term of this patent is extended or adjusted under 35 U.S.C. 154(b) by 0 days.

(21) Appl. No.: 14/096,651

(22) Filed: Dec. 4, 2013

(51) Int. Cl.
*F41G 1/38* (2006.01)
*F41G 1/387* (2006.01)

(52) U.S. Cl.
CPC .. *F41G 1/387* (2013.01); *F41G 1/38* (2013.01)

(58) Field of Classification Search
CPC ..... F41G 1/38
USPC ..... 42/119, 122, 123; 74/553, 813 R, 813 L
See application file for complete search history.

(56) References Cited

U.S. PATENT DOCUMENTS

| | | | | | |
|---|---|---|---|---|---|
| 1,939,540 | A | * | 12/1933 | Charvet | 89/200 |
| 2,797,591 | A | * | 7/1957 | Marrapese | 74/528 |
| 3,990,155 | A | * | 11/1976 | Akin et al. | 42/122 |
| 4,247,161 | A | | 1/1981 | Unertl, Jr. | |
| 4,373,269 | A | | 2/1983 | Doliber et al. | |
| 5,513,440 | A | * | 5/1996 | Murg | 42/122 |
| 5,906,141 | A | * | 5/1999 | Abdelmoula | 74/553 |
| 6,643,970 | B2 | | 11/2003 | Huber | |
| 6,762,884 | B2 | | 7/2004 | Beystrum et al. | |
| 6,772,550 | B1 | | 8/2004 | Leatherwood | |
| 6,862,832 | B2 | * | 3/2005 | Barrett | 42/119 |
| 7,415,791 | B2 | | 8/2008 | Williams, III et al. | |
| 7,483,213 | B2 | | 1/2009 | Pochapsky | |
| 7,612,952 | B2 | | 11/2009 | Schafer | |
| 7,640,830 | B2 | * | 1/2010 | Bonis | 74/813 L |
| 7,913,440 | B2 | | 3/2011 | Murg et al. | |
| 8,006,429 | B2 | | 8/2011 | Windauer | |
| 8,166,696 | B2 | | 5/2012 | Hamilton | |
| 8,270,104 | B2 | * | 9/2012 | Windauer | 359/821 |
| 8,312,667 | B2 | | 11/2012 | Thomas et al. | |
| 8,397,420 | B2 | | 3/2013 | Hamilton | |
| 8,875,435 | B2 | * | 11/2014 | Menges et al. | 42/122 |
| 2003/0140545 | A1 | | 7/2003 | Huber | |
| 2007/0240356 | A1 | | 10/2007 | Klepp et al. | |
| 2008/0236018 | A1 | * | 10/2008 | Halverson | 42/135 |
| 2009/0044660 | A1 | | 2/2009 | Bonis | |
| 2009/0199452 | A1 | | 8/2009 | Huber | |
| 2009/0205461 | A1 | * | 8/2009 | Windauer | 74/553 |
| 2010/0175298 | A1 | | 7/2010 | Thomas et al. | |
| 2010/0229451 | A1 | * | 9/2010 | Hamilton | 42/126 |
| 2011/0061285 | A1 | * | 3/2011 | Hamilton | 42/122 |
| 2011/0102918 | A1 | * | 5/2011 | Windauer | 359/821 |
| 2011/0242650 | A1 | | 10/2011 | Windauer | |

(Continued)

*Primary Examiner* — Bret Hayes
*Assistant Examiner* — Derrick Morgan
(74) *Attorney, Agent, or Firm* — Harness, Dickey & Pierce, P.L.C.

(57) ABSTRACT

An adjustment turret for an optical sight is provided and may include a housing and an adjustment member rotatably supported by the housing and operable to adjust a characteristic of the optical sight when moved relative to the housing. The adjustment turret may additionally include a cap extending from the housing and movable between an engaged state fixing the cap for rotation with the adjustment member and a disengaged state permitting relative rotation between the cap and the adjustment member. The cap may be moveable from the disengaged state to the engaged state in a direction away from the housing.

33 Claims, 7 Drawing Sheets

(56) References Cited

U.S. PATENT DOCUMENTS

| | | | | |
|---|---|---|---|---|
| 2011/0261449 | A1 | 10/2011 | Schmitt | |
| 2012/0147488 | A1* | 6/2012 | Riley | 359/811 |
| 2012/0167444 | A1* | 7/2012 | Adkins et al. | 42/135 |
| 2013/0312310 | A1* | 11/2013 | Geller | 42/122 |
| 2014/0115942 | A1 | 5/2014 | Plaster | |
| 2014/0137458 | A1* | 5/2014 | Crispin | 42/119 |
| 2014/0165782 | A1* | 6/2014 | Windauer | 74/813 L |
| 2014/0352487 | A1* | 12/2014 | Crispin | 74/553 |

* cited by examiner

LOCKING ADJUSTER

FIELD

The present disclosure relates to an optical sight and more particularly to an optical sight for a firearm having a locking adjustment turret.

BACKGROUND

This section provides background information related to the present disclosure which is not necessarily prior art.

Optical sights are commonly used with firearms such as rifles and/or handguns to allow a user to more clearly see a target and aim the firearm at the target. Conventional optical sights include a series of lenses and/or other optical components that magnify an image and provide a reticle to allow a user to align a magnified target relative to a barrel of the firearm. Optical sights may include one or more adjustment mechanisms or "turrets" that allow for adjustment of a position of the reticle relative to the barrel of the firearm to properly "zero" the optical sight to the firearm and/or to account for environmental conditions such as, for example, wind.

SUMMARY

This section provides a general summary of the disclosure, and is not a comprehensive disclosure of its full scope or all of its features.

An adjustment turret for an optical sight is provided and may include a housing and an adjustment member rotatably supported by the housing and operable to adjust a characteristic of the optical sight when moved relative to the housing. The adjustment turret may additionally include a cap extending from the housing and movable between an engaged state fixing the cap for rotation with the adjustment member and a disengaged state permitting relative rotation between the cap and the adjustment member. The cap may be moveable from the disengaged state to the engaged state in a direction away from the housing.

In another configuration, an adjustment turret for an optical sight is provided and may include a housing and an adjustment member rotatably supported by the housing and operable to adjust a characteristic of the optical sight when moved relative to the housing. The adjustment turret may additionally include a cap extending from the housing and movable between an engaged state fixing the cap for rotation with the adjustment member and a disengaged state permitting relative rotation between the cap and the adjustment member. The cap may be rotatable relative to the housing in the disengaged state and the engaged state.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
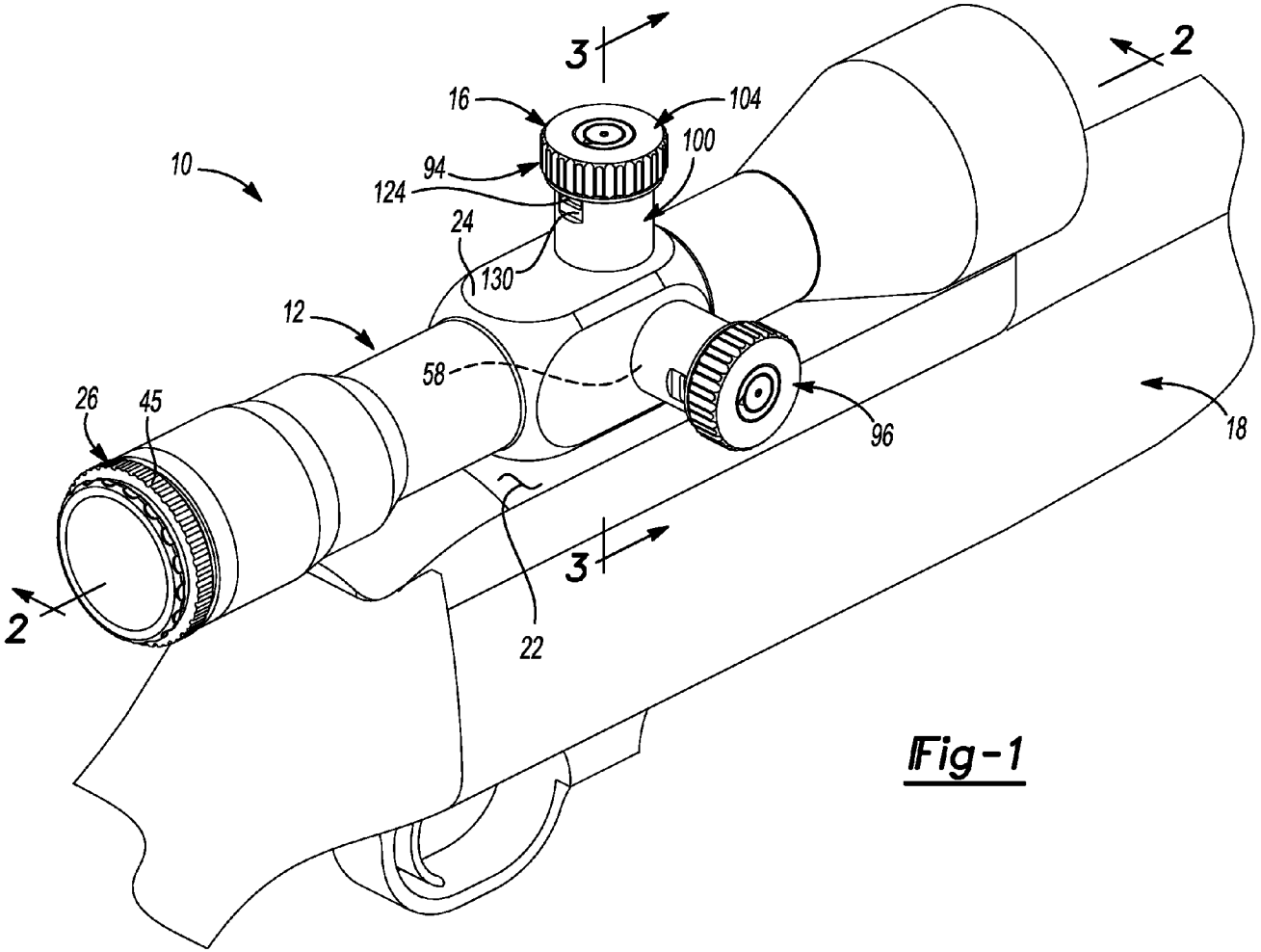
FIG. 1 is a perspective view of an optical sight according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to,"

"directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-4, an optical sight 10 is provided and may include a housing 12, an optics train 14, and an adjustment system 16. The housing 12 is removably attached to a firearm 18 and supports the optics train 14 and the adjustment system 16. The optics train 14 cooperates with the housing 12 to provide a magnified image of a target while the adjustment system 16 positions at least a portion of the optics train 14 relative to the housing 12 to properly align a reticle pattern 20 (FIG. 4) relative to the firearm 18. A light-emitting diode (LED) (not shown) or other illumination system may cooperate with the optics train 14 to illuminate the reticle pattern 20 to assist a user in aligning the target relative to the optical sight 10 and the firearm 18.

The housing 12 may be removably secured to a top surface 22 or a side surface of the firearm 18 and includes a main body 24 attached to an eyepiece 26. The main body 24 may be a generally tubular member including an inner cavity 28 having a longitudinal axis 30, a first end 32, a second end 34, and a tapered portion 36. The first end 32 of the main body 24 may include a threaded inner surface 38 and a threaded outer surface 40 engaging the eyepiece 26. A partially spherical first seat surface 42 may be disposed adjacent to the threaded inner surface 38. A tubular cap 44 may threadably engage the threaded inner surface 38 and may include a partially spherical second seat surface 46 that is directly adjacent to the first seat surface 42 when the tubular cap 44 is assembled within the main body 24. The first and second seat surfaces 42, 46 cooperate to form a partially spherical socket. The second end 34 of the main body 24 is disposed generally on an opposite side of the main body 24 from the first end 32 and includes a generally circular cross section. The tapered portion 36 is disposed between the first end 32 and the second end 34.

The main body 24 supports the adjustment system 16 and may include a first bore 48 (FIGS. 2 and 3) and a second bore 50 (FIG. 3) that receive portions of the adjustment system 16 therein. The first and second bores 48, 50 may include first and second threaded portions 52, 54, respectively, and first and second substantially cylindrical portions 56, 58, respectively. The first and second bores 48, 50 may be rotationally spaced apart from each other about the longitudinal axis 30 by ninety degrees (90°).

Figure 2:
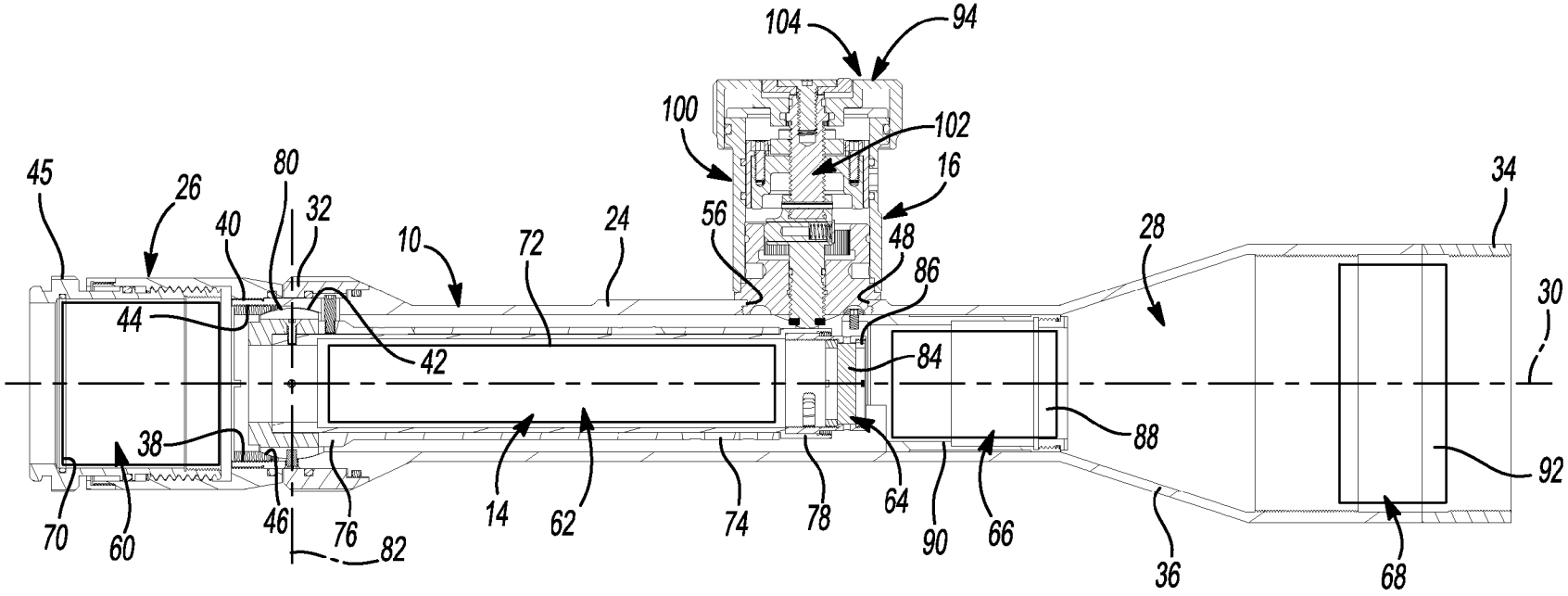
FIG. 2 is a cross-sectional view of the optical sight of FIG. 1 taken along line 2-2.

With particular reference to FIG. 2, the optics train 14 may include an ocular assembly 60, a zoom assembly 62, a reticle assembly 64, a parallax assembly 66, and an objective assembly 68. The ocular assembly 60 may include an ocular-lens assembly 70 housed in the eyepiece 26. The zoom assembly 62 may include a zoom-lens assembly 72 and a zoom-lens housing 74 supporting the zoom-lens assembly 72. A user may rotate a zoom-adjustment ring 45 of the eyepiece 26 to adjust a configuration or position of the zoom-lens assembly 72 relative to the housing 12. The zoom-lens housing 74 may be an elongated, generally tubular member extending generally along the longitudinal axis 30. The zoom-lens housing 74 may include a first end 76 disposed proximate the first end 32 of the main body 24 and a second end 78 disposed between the first end 76 and the tapered portion 36 of the main body 24. The first end 76 may include a partially spherical outer surface 80 that rotatably engages the partially spherical socket formed by the first and second seat surfaces 42, 46. In this manner, the zoom-lens housing 74 may be rotatably movable relative to the main body 24 about a first axis 82 (FIG. 2) and a second axis (not shown) that is positioned within the same plane as the first axis 82 but is offset from the first axis 82 by ninety degrees (90°). The first axis 82 and the second axis are perpendicular to each other and to the longitudinal axis 30.

The reticle assembly 64 may include one or more reticle lenses 84 and a reticle-lens housing 86 supporting the one or more reticle lenses 84. The reticle lens 84 may include the reticle pattern 20 (FIG. 4) formed thereon by an etching process, black-chrome-masking process, and/or diffraction grating process, for example. The reticle-lens housing 86 may engage an inner surface of the second end 78 of the zoom-lens housing 74. Therefore, rotational movement of the zoom-lens housing 74 about the first axis 82 and/or the second axis relative to the main body 24 causes corresponding rotational movement of the reticle-lens housing 86 and the reticle pattern 20 about the first axis 82 and the second axis relative to the main body 24.

The parallax assembly 66 may be disposed between the reticle assembly 64 and the second end 34 of the main body 24 and may include a parallax-lens assembly 88 supported by a parallax housing 90. Finally, the objective assembly 68 may be disposed proximate the second end 34 of the main body 24 and may include an objective-lens assembly 92.

It should be appreciated that the above description of the optics train 14 is provided to illustrate an exemplary configuration of optical components. The principles of the present disclosure are not limited in application to an optical sight having an optics train including the particular components and/or arrangement of components described above. The optical sight 10 may include any other configuration or arrangement of optical components to suit a given application and may provide the optical sight 10 with virtually any magnification.

Figure 3:
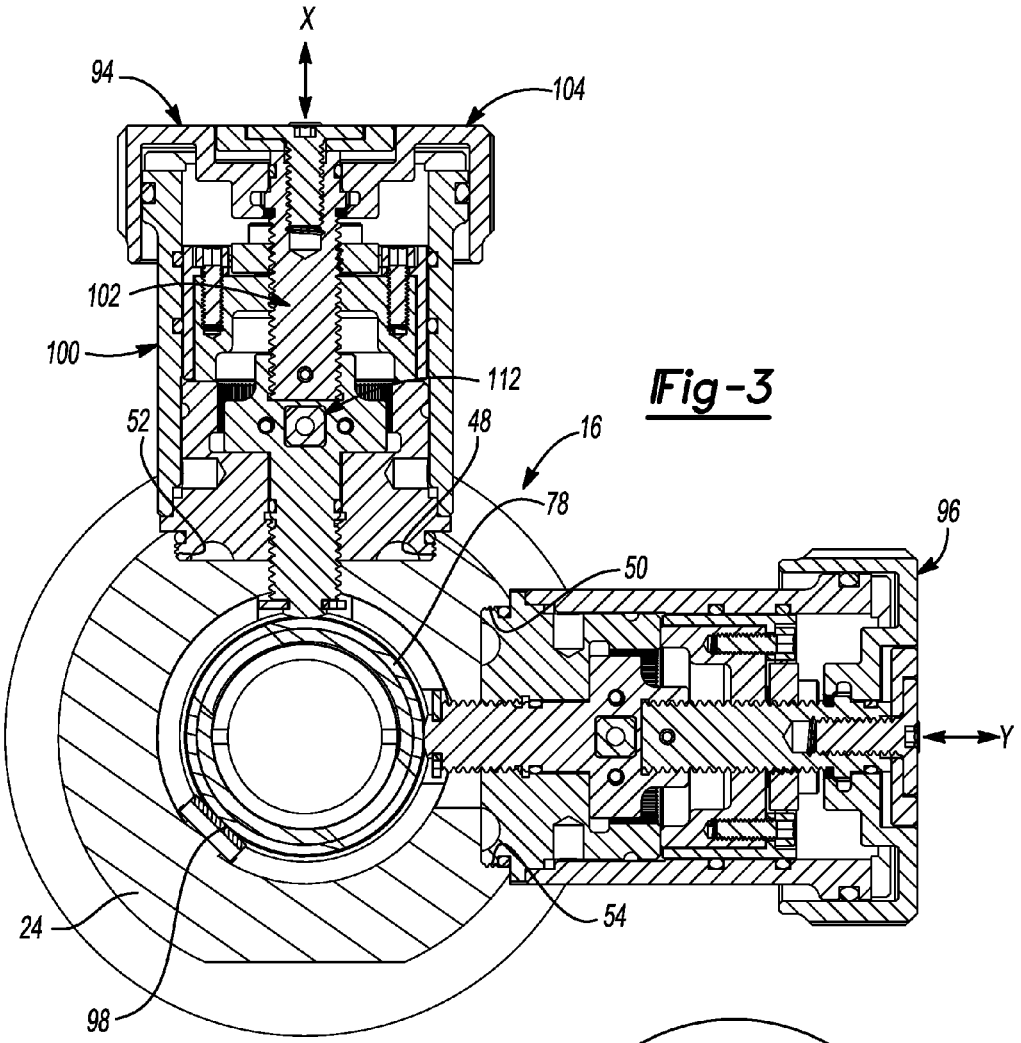
FIG. 3 is a cross-sectional view of the optical sight of FIG. 1 taken along line 3-3 showing an adjustment system according to the principles of the present disclosure.
Figure 4:
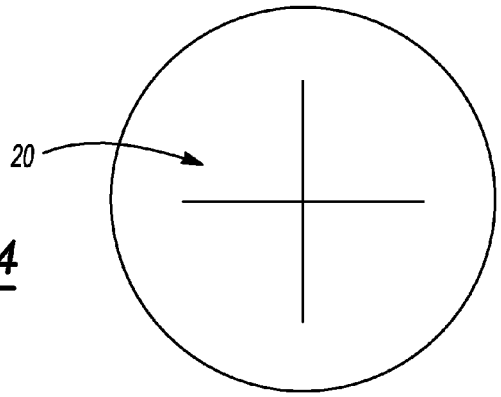
FIG. 4 is a schematic representation of a reticle pattern of the optical sight of FIG. 1.

Referring now to FIGS. 1-3, the adjustment system 16 may include first and second adjuster assemblies or turrets 94, 96 and a biasing member 98 (FIG. 3). The first adjuster assembly 94 may threadably engage the first bore 48 in the main body 24. The second adjuster assembly 96 may threadably engage the second bore 50 in the main body 24. The biasing member 98 may be a leaf spring, for example, or any other spring or resiliently compliant member and may be disposed within the main body 24. As shown in FIG. 3, the biasing member 98 may be rotationally spaced apart from both of the first and second adjuster assemblies 94, 96 about the longitudinal axis 30 by approximately one-hundred-thirty-five degrees (135°) to biasingly oppose both of the first and second adjuster assemblies 94, 96 substantially equally. In one configuration, the biasing member 98 may biasingly contact an outer surface of the zoom-lens housing 74 and bias the zoom-lens housing 74 toward the first and second adjuster assemblies 94, 96.

The first adjuster assembly 94 may cooperate with the biasing member 98 to rotate the zoom-lens housing 74 about the second axis relative to the housing 12. Likewise, the second adjuster assembly 96 may cooperate with the biasing member 98 to rotate the zoom-lens housing 74 about the first axis 82 relative to the housing 12. Movement of the zoom-lens housing 74 relative to the housing 12 similarly moves the reticle-lens housing 86 and the reticle lens 84 to adjust a position of the reticle pattern 20 relative to the housing 12. In this manner, movement of the first adjuster assembly 94 causes corresponding movement of the reticle pattern 20 relative to the housing 12 to align the reticle pattern 20 relative to the firearm 18 to account for elevation. Similarly, movement of the second adjuster assembly 96 causes corresponding movement of the reticle pattern 20 relative to the housing 12 to align the reticle pattern 20 relative to the firearm 18 to account for windage.

The first adjuster assembly 94 may include a body 100, an adjustment screw 102, a cap 104, a lock ring 106, a rotational stop 108, an indicator barrel 110, and a detent mechanism 112. As will be described in greater detail below, the body 100 supports the adjustment screw 102, cap 104, lock ring 106, rotational stop 108, indicator barrel 110, and detent mechanism 112 relative to the housing 12 of the optical sight 10 to allow a user to selectively adjust a position of the reticle-lens housing 86 relative to the housing 12 and, thus, to adjust a position of the reticle pattern 20 relative to the housing 12.

The body 100 may include an upper body portion 114 and a lower body portion 116 that cooperate to support the adjustment screw 102, cap 104, lock ring 106, rotational stop 108, indicator barrel 110, and detent mechanism 112 relative to the housing 12. The upper body portion 114 may include a substantially cylindrical body 118 having a first end 120 and a second end 122. The upper body portion 114 may additionally include an opening 124 that extends between an outer surface 126 and an inner surface 128 of the upper body portion 114. The opening 124 may be formed in a recessed portion 130 that is recessed from the outer surface 126. The opening 124 may receive a sight glass 132 (FIG. 6) that is substantially transparent and allows a user to view internal components of the body 100 once installed. The sight glass 132 may be installed in the opening 124 via a suitable epoxy that seals a joint between the sight glass 132 and an area of the upper body portion 114 at the opening 124 to prevent water and debris from entering the upper body portion 114 at the opening 124.

The lower body portion 116 may be at least partially received within the upper body portion 114 at the second end 122. Namely, the lower body portion 116 may be inserted into the upper body portion 114 at the second end 122 and may be secured to the upper body portion 114 at the second end 122 via a suitable adhesive. Forming the lower body portion 116 separate from the upper body portion 114 allows the lower body portion 116 to be installed in the main body 24 of the housing 12 prior to installation of the upper body portion 114. Allowing the upper body portion 114 to be attached to the lower body portion 116 following attachment of the lower body portion 116 to the main body 24 allows the upper body portion 114 to be positioned relative to the main body 24 such that the opening 124 and, thus, the sight glass 132, extends in a direction substantially away from a muzzle of the firearm 18 and toward a shooter. Once a desired position of the upper body portion 114 relative to the main body 24 and the lower body portion 116 is achieved, the upper body portion 114 may be secured to the lower body portion 116 via a suitable adhesive.

The lower body portion 116 may include a pocket 134 having a series of splines 136 and a bore 138 having a threaded portion 140. The bore 138 may be in communication with the pocket 134 to allow the adjustment screw 102 to extend through the lower body portion 116 once the adjustment screw 102 is installed in the body 100. The lower body portion 116 may additionally include an annular flange 142 that surrounds an outer circumference of the lower body portion 116 and extends generally from an outer surface 144 of the lower body portion 116. The annular flange 142 may extend from the outer surface 144 to provide the lower body portion 116 with a stop that engages the second end 122 of the upper body portion 114 when the upper body portion 114 is installed on the lower body portion 116. Namely, the lower body portion 116 may be installed on the main body 24 by engaging a series of external threads 146 of the lower body portion 116 with the first threaded portion 52 of the first bore 48 until the annular flange 142 contacts the main body 24. At this point, the upper body portion 114 may be installed on the lower body portion 116 such that the outer surface 144 is received within the upper body portion 114. The upper body portion 114 may be positioned relative to the lower body portion 116 and, thus, the main body 24, by engaging the second end 122 of the cylindrical body 118 with the annular flange 142 of the lower body portion 116.

At this point, the upper body portion 114 may be rotated relative to and about the lower body portion 116 until the opening 124 is properly positioned relative to the firearm 18 such that the opening 124 faces in a direction substantially away from the muzzle of the firearm 18. Once properly positioned, the upper body portion 114 may be secured to the lower body portion 116 at a junction of the second end 122 and the annular flange 142 via a suitable adhesive. As described, the annular flange 142 may engage both the main body 24 of the housing 12 as well as the second end 122 of the upper body portion 114 to properly position the lower body portion 116 relative to the main body 24 and, likewise, to properly position the upper body portion 114 relative to the lower body portion 116. In short, the annular flange 142 may act as a spacer to properly position the upper body portion 114 relative to the main body 24.

Figure 6:
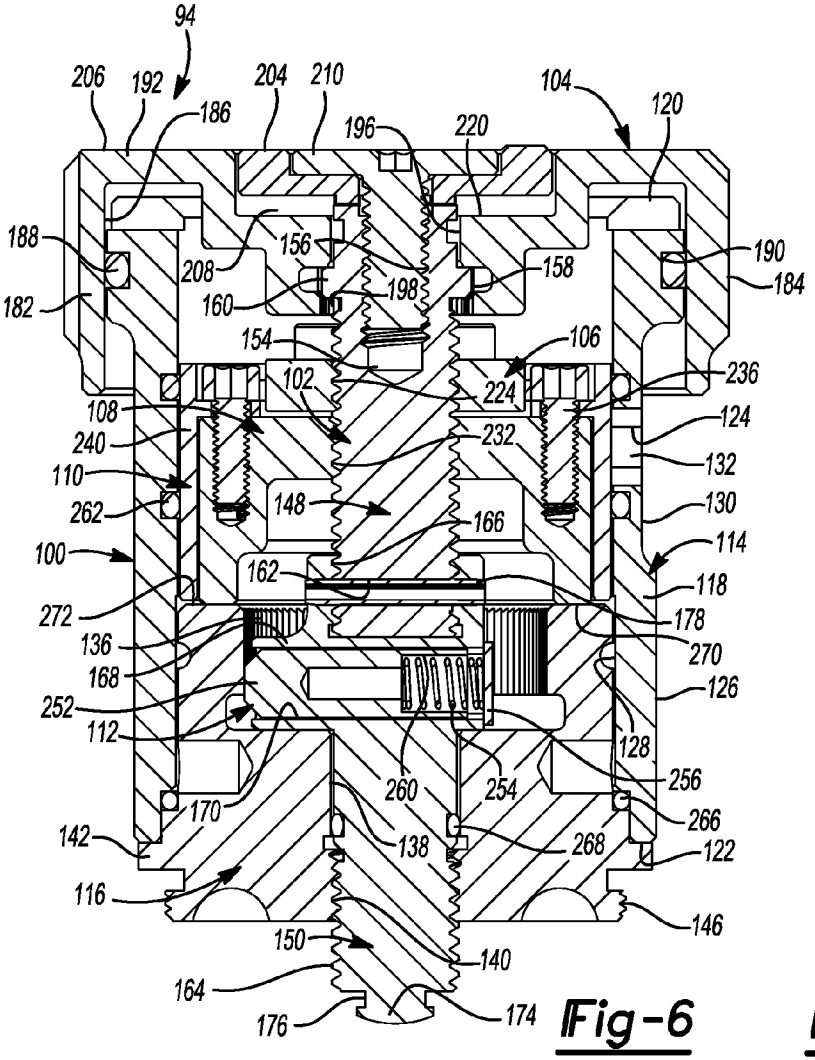
FIG. 6 is a cross-sectional view of the adjustment system of FIG. 3 showing an adjustment turret in a disengaged and fully down position.

The adjustment screw 102 may be received by the body 100 and may include an upper shaft 148 and a lower shaft 150. The upper shaft 148 may include a series of external threads 152, a bore 154 having a series of internal threads 156, and a series of splines 158 formed at a distal end of an annular flange 160 (FIG. 6). Finally, the upper shaft 148 may include a cross-bore 162 for use in attaching the lower shaft 150 to the upper shaft 148, as will be described in greater detail below.

The lower shaft 150 may include a series of external threads 164, a series of internal threads 166, and a detent housing 168. The detent housing 168 may be positioned along a length of the lower shaft 150 generally between the external threads 164 and the internal threads 166 and may support the detent mechanism 112 relative to the lower body portion 116 of the body 100. Accordingly, the detent housing 168 may include a bore 170 that slidably receives a portion of the detent mechanism 112 as well as a pair of threaded bores that may be used to retain the detent mechanism 112 within the bore 170.

The lower shaft 150 may additionally include a projection 174 having an annular groove 176. The annular groove 176 may receive a substantially C-shaped retaining ring (not shown) to act as a stop when the adjustment screw 102 is moved in a direction generally away from the lower body portion 116 to the upper body portion 114. Namely, the retaining ring may engage the lower body portion 116 when the adjustment screw 102 is moved in a direction generally away from the lower body portion 116 to the upper body portion 114 to restrict further movement of the adjustment screw 102.

The upper shaft 148 may be attached to the lower shaft 150 via a pin 178. Specifically, the pin 178 may be inserted into an aperture 180 of the lower shaft 150 and may subsequently be inserted into the cross-bore 162 of the upper shaft 148. Insertion of the pin 178 into the aperture 180 of the lower shaft 150 and into the cross-bore 162 of the upper shaft 148 fixes the upper shaft 148 for rotation with the lower shaft 150.

The adjustment screw 102 may be selectively rotated relative to the body 100 by applying a force on the cap 104. Namely, a force may be applied to the cap 104 to move the cap 104 in a direction away from the upper body portion 114. A rotational force may subsequently be applied to the cap 104 to cause rotation of the adjustment screw 102 relative to the body 100, as will be described in greater detail below. The cap 104 may be positioned relative to the upper body portion 114 such that the first end 120 of the upper body portion 114 is received within the cap 104.

The cap 104 may include a depending wall portion 182 having a series of gripping features 184 located on an opposite side of the wall portion 182 from an inner surface 186. The inner surface 186 may oppose a portion of the upper body portion 114 when the upper body portion 114 is inserted into the cap 104 at the first end 120 of the upper body portion 114. A junction between the inner surface 186 of the wall portion 182 and an outer surface of the upper body portion 114 may be sealed via a suitable seal such as, for example, an O-ring seal 188. Specifically, the O-ring seal 188 may be received within an annular groove 190 formed in the upper body portion 114 proximate to the first end 120 to prevent water and other debris from entering the upper body portion 114 at the junction of the upper body portion 114 and the cap 104. The seal 188 engages the inner surface 186 to prevent intrusion of water and other debris at the junction of the inner surface 186 and the upper body portion 114 while concurrently permitting movement of the cap 104 relative to the upper body portion 114 in the direction indicated by arrow A shown in FIG. 8.

The cap 104 may additionally include a top wall 192 extending substantially perpendicular to the depending wall portion 182 and a recess 194 formed in the top wall 192. The recess 194 may include a bore 196 formed therethrough that permits access to an interior of the upper body portion 114 at the top wall 192. The bore 196 may include a series of splines 198 that selectively engage the splines 158 of the adjustment screw 102 to selectively fix the adjustment screw 102 for rotation with the cap 104, as will be described in greater detail below.

The cap 104 may be attached to the upper shaft 148 of the adjustment screw 102 via a cap screw 200 and cap retainer 202. Specifically, the cap retainer 202 may be received by the recess 194 such that a top surface 204 of the cap retainer 202 is substantially flush with a top surface 206 of the top wall 192. The cap retainer 202 may include a recessed portion 208 that receives a head 210 of the cap screw 200 when the cap screw 200 is installed in the cap retainer 202 and cap 104. In one configuration, the recessed portion 208 is sized to receive the head 210 such that the top surface 204 of the cap retainer 202 is substantially flush with an outer surface 212 of the head 210 when the cap screw 200 is installed.

The cap screw 200 may include a threaded stud 214 that is received by an aperture 216 of the cap retainer 202 and threadably engages the internal threads 156 of the bore 154 to attach the cap screw 200 to the adjustment screw 102 at the upper shaft 148. Attaching the cap screw 200 to the upper shaft 148 likewise attaches the cap retainer 202 and the cap 104 to the upper shaft 148 of the adjustment screw 102, as the cap retainer 202 and cap 104 are disposed between the head 210 of the cap screw 200 and the upper shaft 148 of the adjustment screw 102.

Figure 8:
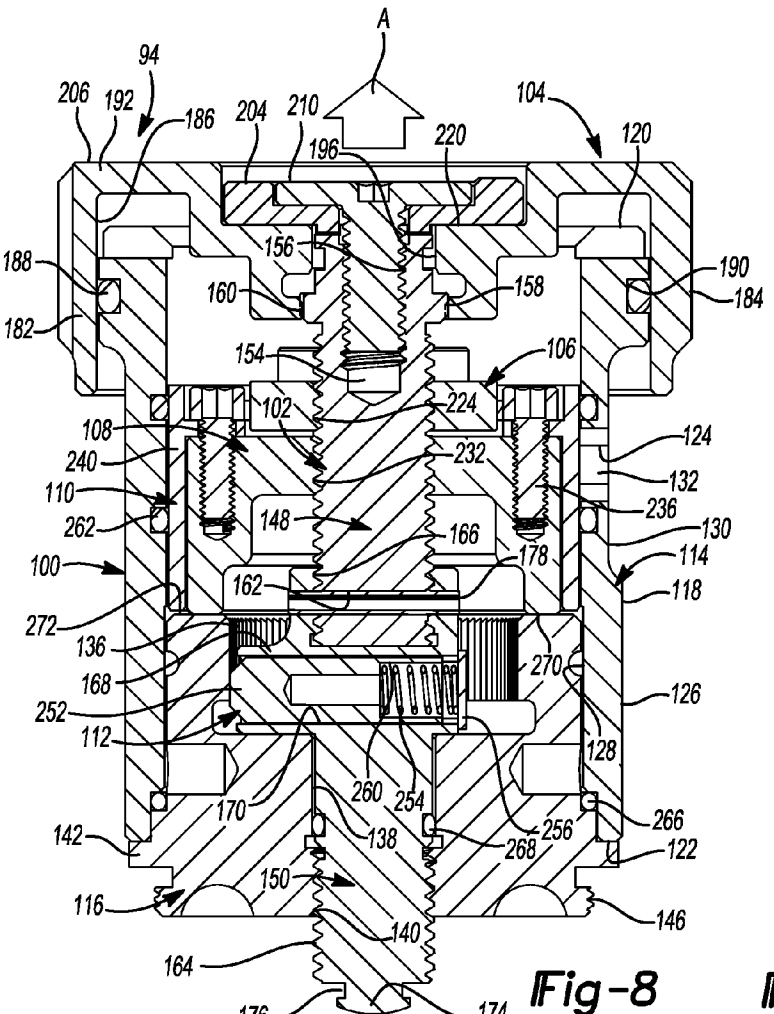
FIG. 8 is a cross-sectional view of the adjustment system of FIG. 3 showing an adjustment turret in an engaged and fully down position.

While the cap 104 is described as being attached to the upper shaft 148 of the adjustment screw 102, the cap 104 is permitted to move relative to the upper shaft 148 in the direction (A), as shown in FIG. 8. Namely, the cap 104 may be moved from a disengaged position (FIG. 6) to an engaged position (FIG. 8) by applying a force on the cap 104 in the direction (A). When the cap 104 is in the disengaged position, the splines 198 of the cap 104 are disengaged from the splines 158 of the upper shaft 148 such that the cap 104 is permitted to freely rotate relative to and about the adjustment screw 102 without causing concurrent rotation of the adjustment screw 102 relative to the body 100. When the cap 104 is moved into the engaged position (FIG. 8), the splines 198 of the cap 104 engage the splines 158 of the upper shaft 148, thereby fixing the cap 104 for rotation with the adjustment screw 102. Accordingly, when a rotational force is applied to the cap 104, the adjustment screw 102 is rotated relative to the body 104.

As shown in FIG. 6, the cap retainer 202 provides for movement of the cap 104 from the disengaged position (FIG. 6) to the engaged position (FIG. 8). Namely, the cap retainer 202 is sized such that a gap 208 (FIG. 6) exists between the cap retainer 202 and a bottom surface 220 of the recess 194. When the cap 104 is in the disengaged position (FIG. 6), the gap 208 is formed between the cap retainer 202 and the bottom surface 220 of the recess 194. Conversely, when the cap 104 is moved into the engaged position (FIG. 8), the gap 208 closes and the bottom surface 220 of the recess 194 is moved into engagement with the cap retainer 202. Accordingly, the cap retainer 202 acts as a stop and prevents further movement of the cap 104 in a direction substantially away from the body 100 and in the direction (A).

The lock ring 106 and the rotational stop 108 are threadably attached to the adjustment screw 102 and may cooperate with the body 100 to provide the first adjuster assembly 94 with a rotational stop. Namely, a position of the rotational stop 108 relative to the upper shaft 148 of the adjustment screw 102 may be selectively adjusted to change the rotational stop of the adjustment screw 102 by rotating the rotational stop 108 relative to the upper shaft 148. Once a desired position of the rotational stop 108 relative to the upper shaft 148 is achieved, the lock ring 106 may cooperate with the rotational stop 108 to create an interference fit between the lock ring 106, the rotational stop 108, and the upper shaft 148.

The lock ring 106 may include a central bore 222 having a series of threads 224. The threads 224 may threadably engage the external threads 152 of the upper shaft 148 such that rotation of the lock ring 106 relative to the upper shaft 148 causes the lock ring 106 to move relative to the upper shaft 148 in a direction substantially parallel to a longitudinal axis of the adjustment screw 102. The lock ring 106 may additionally include a series of threaded bores 226 that respectively receive threaded fasteners 228.

The rotational stop 108 similarly includes a central bore 230 having a series of threads 232 that threadably engage the external threads 152 of the upper shaft 148. The rotational stop 108 may additionally include a series of threaded bores 234 that respectively receive threaded fasteners 236. Finally, the rotational stop 108 includes a series of threaded bores 238 that threadably receive the fasteners 228 to selectively fix a position of the lock ring 106 and rotational stop 108 along a length of the upper shaft 148.

Figure 11:
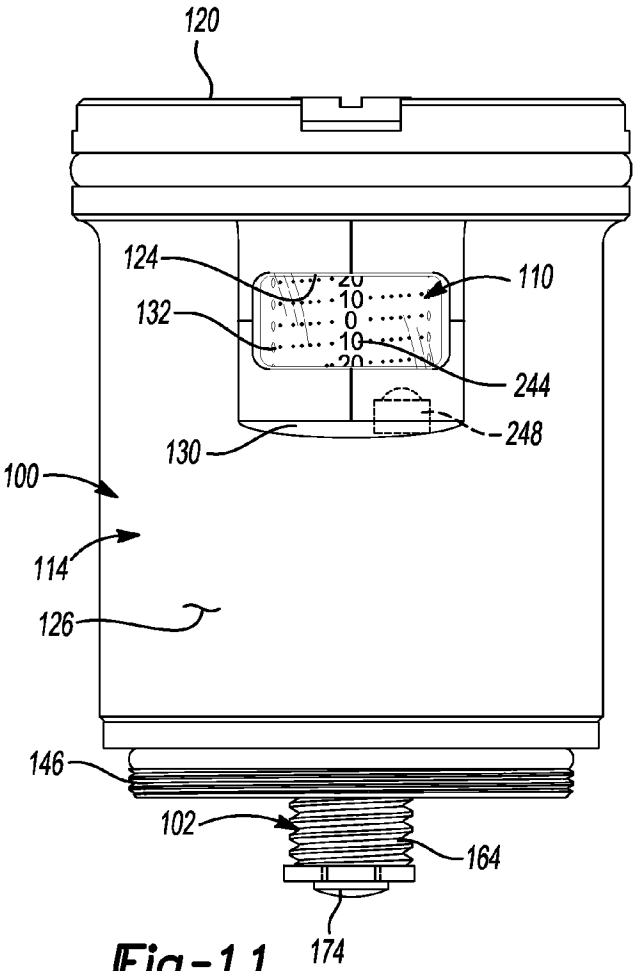
FIG. 11 is a side view of the adjustment system of FIG. 3 showing a sight window and adjustment indicia.

The indicator barrel 110 may receive a portion of and may be attached to the rotational stop 108. The indicator barrel 110 may include a wall portion 240 and an annular ring 242 disposed within the wall portion 240. The wall portion 240 may include a series of indicia 244 (FIG. 11) that aid a shooter in adjusting a position of the reticle-lens housing 86 relative to the body 100 and, thus, a position of the reticle pattern 20 viewed at the eyepiece 26. The indicia 244 may be etched and/or printed on an outer surface 246 of the indicator barrel 110 to allow a user to view the indicia 244 through the opening 124 of the body 100 via the sight glass 132. In one configuration, the indicia 244 may be applied via a luminescent paint that allows the indicia 244 to glow in low-light conditions. Additionally or alternatively, the upper body portion 114 may include a lamp 248 (FIG. 11) such as a light-emitting diode (LED) that illuminates the outer surface 246 and, thus, the indicia 244, in low-light conditions. The lamp 248 may be automatically illuminated via a photodiode (not shown) to allow the lamp 248 to automatically respond to ambient light conditions in an area surrounding the optical sight 10. Alternatively, the lamp 248 may be manually actuated via a switch (not shown) to allow a shooter to manually toggle the lamp 248 between an ON state and an OFF state. Regardless of whether the indicia 244 are illuminated via a photo luminescent paint and/or a lamp, the indicia 244 allow the shooter to determine a degree of adjustment of the first adjuster assembly 94 by viewing the indicia 244 at the sight glass 132.

The annular ring 242 may extend into an interior of the indicator barrel 110 and may include adjustment slots 250. The adjustment slots 250 may respectively receive the threaded fasteners 236 such that the threaded fasteners 236 are received by the adjustment slots 250 of the indicator barrel 110 as well as by the threaded bores 234 of the rotational stop 108. The threaded fasteners 236 may be moved between a disengaged state that permits rotation of the indicator barrel 110 about a longitudinal axis of the adjustment screw 102 and relative to the rotational stop 108 and an engaged state that fixes the indicator barrel 110 to the rotational stop 108 to prevent rotation of the indicator barrel 110 relative to the rotational stop 108. When the threaded fasteners 236 are in the disengaged state, the indicator barrel 110 is rotatable relative to the rotational stop 108 and, as a result, the adjustment slots 250 are permitted to move relative to the threaded fasteners 236. Once a desired position of the indicator barrel 110 relative to the rotational stop 108 is achieved, the fasteners 236 may be moved from the disengaged state to the engaged state by rotatably driving the fasteners 236 into the rotational stop 108 to fix a position of the indicator barrel 110 relative to the rotational stop 108.

Figure 5:
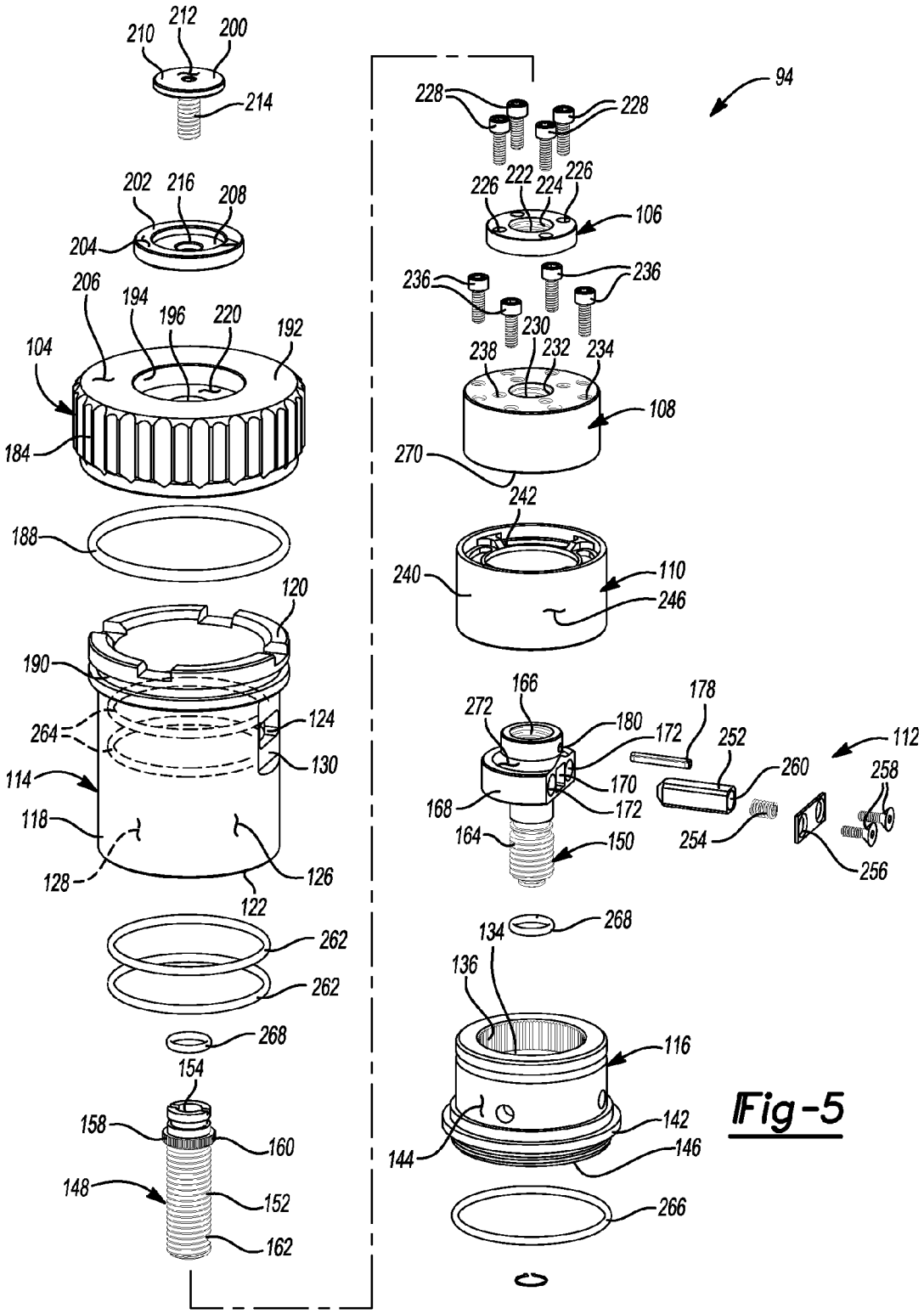
FIG. 5 is an exploded perspective view of an adjustment turret of the adjustment system of FIG. 3.
Figure 7:
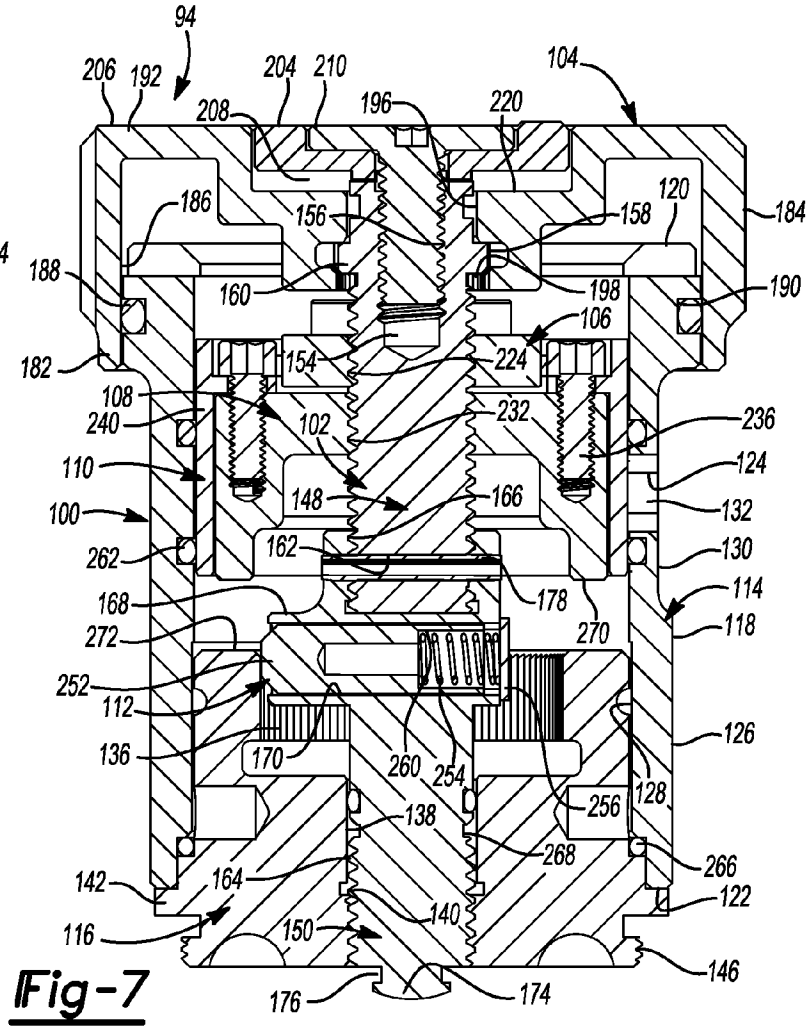
FIG. 7 is a cross-sectional view of the adjustment system of FIG. 3 showing an adjustment turret in a disengaged and fully up position.

With particular reference to FIGS. 5 and 6, the detent mechanism 112 is shown to include a plunger 252, a biasing member 254, a plate 256, and a pair of fasteners 258. The plunger 252 is slidably received within the bore 170 of the detent housing 168 and is permitted to slide within the bore 170 relative to the detent housing 168. The plunger 252 may include a pocket 260 (FIG. 6) that receives a portion of the biasing member 254 therein. The biasing member 254 is maintained within the pocket 260 via the plate 256, which is attached to the detent housing 168 via engagement between the fasteners 258 and respective threaded bores 172 of the detent housing 168. Once the plunger 252, biasing member 254, and plate 256 are installed in the detent housing 168, the plunger 252 is biased into engagement with the splines 136 of the lower body portion 116. Engagement between the plunger 252 and the splines 136 maintains a desired rotational position of the lower shaft 150 and, thus, the adjustment screw 102 relative to the body 100.

When the lock ring 106 is fixed to the rotational stop 108 such that the lock ring 106 and rotational stop 108 create an interference fit between the lock ring 106, the rotational stop 108, and the adjustment screw 102, the adjustment screw 102 is likewise fixed for movement with the indicator barrel 110. Accordingly, the plunger 252 maintains a rotational position of the adjustment screw 102 and the indicator barrel 110 relative to the body 100 until the cap 104 is moved in a direction away from the first end 120 of the upper body portion 114 to allow engagement between the splines 158 of the upper shaft 148 and the splines 198 of the cap 104. At this point, a force may be applied to the cap 104 to rotate the adjustment screw 102 relative to the body 100, thereby overcoming the force exerted on the plunger 252 by the biasing member 254 to permit rotation of the adjustment screw 102 and, thus, the plunger 252, relative to the body 100. Such movement of the plunger 252 relative to the body 100 causes the plunger 252 to produce a series of audible noises or "clicks," as the plunger 252 moves from adjacent recesses created by the splines 136 of the movement of the lower shaft 150 relative to the plunger 252. Such audible noises aid a shooter in adjusting a position of the reticle pattern 20 simply by listening to the number of "clicks" produced as the lower shaft 150 of the adjustment screw 102 is moved relative to the plunger 252 of the detent mechanism 112.

With particular reference to FIGS. 5 and 6, assembly of the first adjuster assembly 94 will be described in detail. As indicated above, the body 100 includes an upper body portion 114 and a lower body portion 116 that are movable relative to one another prior to assembly of the first adjuster assembly 94. Accordingly, the lower body portion 116 may threadably engage the main body 24 of the housing 12 via the external threads 146 of the lower body portion 116. Upon tightening of the lower body portion 116 to the main body 24, the internal components of the first adjuster assembly 94 may be installed. Namely, the detent mechanism 112 may be assembled to the lower shaft 150 of the adjustment screw 102 which, in turn, may be attached to the upper shaft 148 via the pin 178. The adjustment screw 102 may then be threadably attached to the lower shaft 150 via engagement between the threaded portion 140 of the lower body portion 116 and the external threads 164 of the lower shaft 150. The lock ring 106, rotational stop 108, and indicator barrel 110 may then be threadably coupled to the upper shaft 148 via the external threads 152 of the upper shaft 148 and the internal threads 224 of the lock ring 106 and the threads 232 of the rotational stop 108. The indicator barrel 110 may be installed by inserting the fasteners 236 into the adjustment slots 250 of the indicator barrel 110 and, subsequently, into the threaded bores 234 of the rotational stop 108. Finally, the cap 104 may be attached to the adjustment screw 102 via the cap screw 200 and cap retainer 202. While the internal components of the first adjuster assembly 94 are described as being installed following tightening of the lower body portion 116 to the main body 24, the internal components of the first adjuster assembly 94 could be installed before tightening of the lower body portion 116 to the main body 24.

As shown in FIG. 6, the first adjuster assembly 94 may include the O-ring seal 188 to seal a junction between the inner surface 186 of the cap 104 and the upper body portion 114. The first adjuster assembly 94 may additionally include a pair of O-ring seals 262 received within grooves 264 formed in the upper body portion 114 to seal a junction between the upper body portion 114 and the indicator barrel 110. Likewise, an O-ring seal 266 may be located at a junction of the upper body portion 114 and the lower body portion 116 to provide a seal between the upper body portion 114 and the lower body portion 116. The seal 266 may be an O-ring seal and may be used in conjunction with an adhesive at a junction of the upper body portion 114 and the lower body portion 116 to prevent water and other debris from entering the body 100. Finally, additional O-ring seals 268 may additionally seal a junction between the lower body portion 116 and the lower shaft 115 to once again prevent water and other debris from entering the body 100.

Because the first adjuster assembly 94 may be substantially identical to the second adjuster assembly 96, a detailed description of the second adjuster assembly 96 is foregone.

With reference to FIGS. 1-12, operation of the adjustment system 16 will be described in detail. As described above, a user may operate the adjustment system 16 to adjust a position of the reticle-lens housing 86 and, thus, the reticle pattern 20 relative to a barrel of the firearm 18 to account for windage and elevation. The first adjuster assembly 94 and the biasing member 98 may cooperate to adjust a position of the reticle pattern 20 in a first dimension X (FIG. 3) to account for distance and elevation between the firearm 18 and the target. Likewise, the second adjuster assembly 96 and the biasing member 98 may cooperate to adjust a position of the reticle pattern 20 in a second dimension Y (FIG. 3) to account for windage. Because operation of the first adjuster assembly 94 may be substantially identical to operation of the second adjuster assembly 96, a detailed description of operation of the second adjuster assembly 96 is foregone.

The first adjuster assembly 94 may be used to adjust a position of the reticle-lens housing 86 relative to the main body 24 of the housing 12. In so doing, the first adjuster assembly 94 likewise adjusts a position of the reticle lens 84 and, thus, the reticle pattern 20 relative to the main body 24. A shooter may therefore use the first adjuster assembly 94 to adjust a position of the reticle pattern 20 to adjust a point of aim (POA) and a point of impact (POI) to account for targets of varying distances. In short, the first adjuster assembly 94 may be used to adjust an elevation of the optical sight 10. While the second adjuster assembly 96 operates in a virtually identical fashion as the first adjuster assembly 94, the second adjuster assembly 96 may be used to adjust a position of the reticle pattern 20 to adjust the windage of the optical sight 10.

When the first adjuster assembly 94 is initially installed on the optical sight 10 or the optical sight 10 is first installed on the firearm 18, the optical sight 10 may be zeroed to achieve a POA and POI for a particular distance. Namely, a shooter may install the optical sight 10 including the first adjuster assembly 94 and the second adjuster assembly 96 and may use the optical sight 10 in conjunction with the firearm 18 at a shooting range, for example, to zero the optical sight 10. The shooter may align the optical sight 10 and, thus, the firearm 18 with a target at a known distance and may adjust a position of the reticle pattern 20 by using the first adjuster assembly 94 and the second adjuster assembly 96 until a desired POA and POI are achieved.

Figure 10:
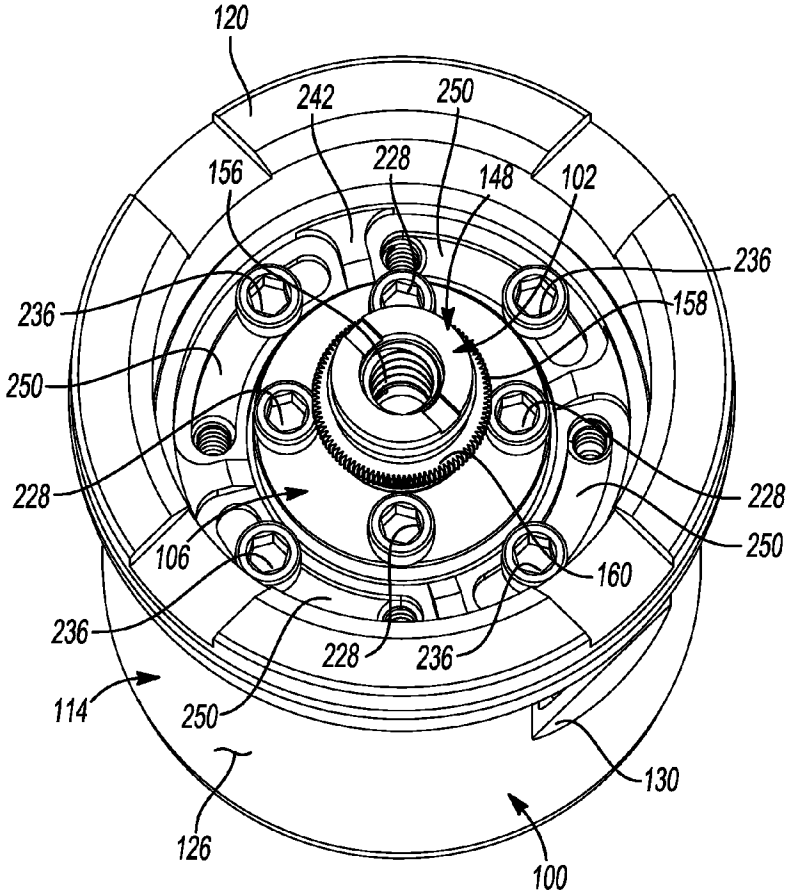
FIG. 10 is a perspective view of the adjustment system of FIG. 3 with a part of a housing removed to show internal components of the adjustment system.

Once the desired POA and POI are achieved, the shooter may adjust the first adjuster assembly 94 and the second adjuster assembly 96 by removing the cap screw 200, the cap retainer 202, and the cap 104. At this point, access to the threaded fasteners 228 and 236 is permitted (FIG. 10). The shooter may loosen the fasteners 228 to relieve the interference fit created by the lock ring 106, the rotational stop 108, and the adjustment screw 102, thereby permitting the lock ring 106 and the rotational stop 108 to be movable relative to and along the upper shaft 148 of the adjustment screw 102.

A rotational force may be applied to the lock ring 106 to rotate the lock ring 106 and the rotational stop 108 about the upper shaft 148. Rotation of the lock ring 106 and the rotational stop 108 along the upper shaft 148 is accomplished via engagement between the threads 224 of the lock ring 106 and the threads 232 of the rotational stop 108 with the external threads 152 of the upper shaft 148. The lock ring 106 and rotational stop 108 continue to move along the adjustment screw 102 as the rotational force applied to the lock ring 106 is maintained until an engagement surface 270 of the rotational stop 108 contacts a stop surface 272 of the lower shaft 150. At this point, further movement of the lock ring 106 and rotational stop 108 in a direction away from the first end 120 of the upper body portion 114 is prohibited.

Once the engagement surface 270 of the rotational stop 108 is in contact with the stop surface 272 of the lower shaft 150, the threaded fasteners 228 may be tightened, thereby creating an interference fit amongst the lock ring 106, the rotational stop 108, and the adjustment screw 102. The interference fit prevents rotation of the lock ring 106 and the rotational stop 108 relative to the adjustment screw 102 and, therefore, fixes a position of the lock ring 106 and the rotational stop 108 along a length of the adjustment screw 102.

The shooter may identify the zeroed position of the optical sight 10 by adjusting a position of the indicator barrel 110 relative to the rotational stop 108. Namely, a rotational force may be applied to the indicator barrel 110 when the threaded fasteners 236 are in the disengaged state to cause the indicator barrel 110 to rotate relative to the rotational stop 108. The indicator barrel 110 may be rotated relative to the rotational stop 108 until the "zero" indicia 244 is shown in the sight glass 132. Once the indicator barrel 110 is properly positioned such that the "zero" indicia 244 is shown through the sight glass 132, the fasteners 236 may be returned to the engaged state to fix a rotational position of the indicator barrel 110 relative to the rotational stop 108. At this point, the cap 104 may be reassembled to the body 100 via the cap screw 200 and cap retainer 202.

In operation, when a shooter desires to adjust the elevation of the optical sight 10, a force may be applied to the cap 104 to move the cap 104 in a direction generally away from the first end 120 of the body 100. In so doing, the splines 198 of the cap 104 are moved into meshed engagement with the splines 158 of the upper shaft 148 of the adjustment screw 102, thereby fixing the cap 104 for rotation with the adjustment screw 102. Accordingly, a rotational force may be applied to the adjustment screw 102 via the cap 104 to cause the adjustment screw 102 to rotate relative to the body 100.

Rotating the adjustment screw 102 relative to the body 100 causes the adjustment screw 102 to move in a direction either toward the first end 120 of the upper body portion 114 or away from the first end 120 of the upper body portion 114. Because the reticle-lens housing 86 is biased into engagement with the lower shaft 150 at the projection 174, movement of the adjustment screw 102 relative to the body 100 likewise adjusts a position of the reticle-lens housing 86 relative to the main body 24 of the housing 12. For example, when the adjustment screw 102 is rotated via the cap 104 such that the adjustment screw 102 moves in a direction away from the first end 120 of the upper body portion 114, the projection 174 of the lower shaft 150 extends away from the lower body portion 116 to a greater extent. Accordingly, a force is applied to the reticle-lens housing 86 against the force exerted thereon by the biasing member 98. Accordingly, a position of the reticle-lens housing 86 and, thus, the reticle pattern 20 relative to and within the main body 24, is adjusted. Conversely, when the adjustment screw 102 is rotated relative to the body 100 in an opposite direction such that the projection 174 of the lower shaft 150 is moved into closer proximity to the lower body portion 116, the biasing member 98 is permitted to move the reticle-lens housing 86 in a direction generally toward the first adjuster assembly 94, thereby adjusting a position of the reticle-lens housing 86 and, thus, the reticle pattern 20, relative to and within the main body 24.

Once a desired position of the reticle-lens housing 86 and, thus, the reticle pattern 20, is achieved, the force applied on the cap 104 may be released to move the cap 104 in a direction generally toward the first end 120 of the upper body portion 114.

Upon sufficient movement of the cap 104 in a direction toward the first end 120 of the upper body portion 114, the splines 198 of the cap 104 disengage the splines 158 of the upper shaft 148, thereby allowing rotation of the cap 104 relative to the upper shaft 148. As such, the cap 104 may be freely rotated relative to the upper shaft 148 without causing movement of the adjustment screw 102 relative to the body 100. Accordingly, inadvertent adjustment of the adjustment screw 102 and, thus, the reticle pattern 20, is restricted.

The desired position of the reticle-lens housing 86 and, thus, the reticle pattern 20, is accomplished via interaction between the detent mechanism 112 and the lower shaft 150 of the adjustment screw 102. Namely, interaction between the plunger 252 and the splines 136 of the detent housing 168 maintain a rotational position of the adjustment screw 102 relative to the body 100. Only when the splines 158 of the adjustment screw 102 are meshed with the splines 198 of the cap 104 can a force be applied to the adjustment screw 102 to overcome the force exerted on the lower shaft 150 via the plunger 252. As described above, engagement between the splines 158, 198 is only accomplished when the cap 104 is moved in a direction substantially away from the first end 120 of the upper body portion 114.

Figure 9:
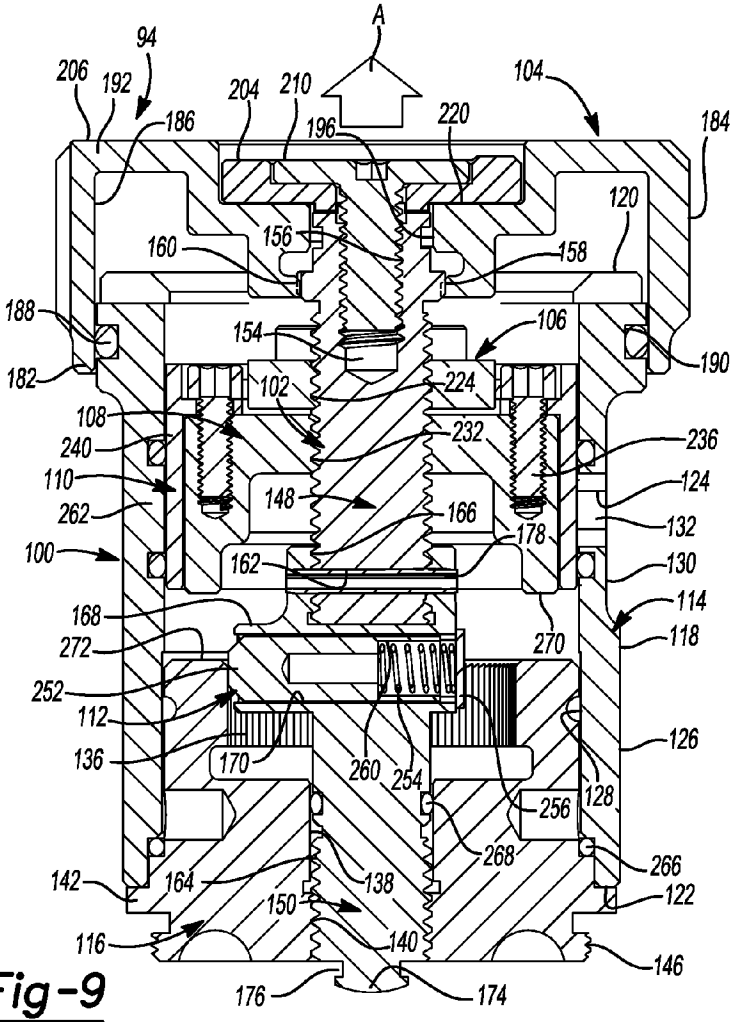
FIG. 9 is a cross-sectional view of the adjustment system of FIG. 3 showing an adjustment turret in an engaged and fully up position.

When the cap 104 is moved in the position shown in FIGS. 8 and 9 such that the splines 198 of the cap 104 are in engagement with the splines 158 of the adjustment screw 102, a rotational force applied to the cap 104 causes rotation of the adjustment screw 102 relative to the detent mechanism 112. Accordingly, the plunger 252 moves along and engages different splines 136 of the lower shaft 150. In so doing, an audible noise is produced each time the plunger 252 engages a different spline 136. This audible noise may be used by the shooter to adjust a position of the reticle pattern 20 by simply counting the number of "clicks" produced by the plunger 252 during rotation of the adjustment screw 102 relative to the detent mechanism 112.

In addition to use of the audible noise produced by the detent mechanism 112, a shooter may also determine the amount of adjustment of the reticle pattern 20 by viewing the indicia 244 at the sight glass 132. Namely, as the adjustment screw 102 is rotated relative to the body 100, the lock ring 106, rotational stop 108, and indicator barrel 110 are likewise rotated relative to the body 100. Accordingly, the indicia 244 of the indicator barrel 110 are rotated relative to the upper body portion 114 and, thus, relative to the sight glass 132. As such, different indicia 244 may be displayed at the sight glass 132 depending on the rotational position of the indicator barrel 110 relative to the body 100. The indicia 244 may be formed at a similar or identical angle/pitch on the indicator barrel 110 as the pitch of the external threads 164 of the lower shaft 150. Accordingly, the indicia 244 displayed at the sight glass 132 move in conjunction with linear movement of the adjustment screw 102 when a rotational force is applied to the cap 104.

As described, the first adjuster assembly 94 and the second adjuster assembly 96 may be used to selectively adjust a position of the reticle pattern 20 relative to the firearm 18 to aid a shooter in positioning a firearm 18 relative to a desired target. Such adjustment of the first adjuster assembly 94 and the second adjuster assembly 96 is only accomplished when the top cap 104 is moved away from the body 100 to allow the splines 198 of the cap 104 to engage the splines 158 of the adjustment screw 102. Accordingly, inadvertent adjustment of the adjustment screw 102 is prohibited, as the cap 104 is permitted to freely rotate relative to the adjustment screw 102 when the splines 198 of the cap 104 are disengaged from the splines 158 of the adjustment screw 102.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An adjustment turret for an optical sight, the adjustment turret comprising:

a housing;

an adjustment member rotatably supported by said housing, said adjustment member operable to adjust a characteristic of the optical sight when moved relative to said housing;

a cap extending from said housing and movable between an engaged state fixing said cap for rotation with said adjustment member and a disengaged state permitting relative rotation between said cap and said adjustment member, said cap moveable from said disengaged state to said engaged state in a direction away from said housing;

a sight glass supported by said housing, said sight glass providing visual access to indicia fixed for rotation with said adjustment member; and an illumination device operable to illuminate said indicia.

2. The adjustment turret of claim 1, wherein said cap is rotatable relative to said housing in said engaged state and said disengaged state.

3. The adjustment turret of claim 1, wherein said cap includes a first series of splines and said adjustment member includes a second series of splines, said first series of splines are engaged with said second series of splines when said cap is in said engaged state and are disengaged from said second series of splines when said cap is in said disengaged state.

4. The adjustment turret of claim 1, wherein said housing includes a first housing portion and a second housing portion, said first housing portion cooperating with said second housing portion to define an inner volume that receives said adjustment member.

5. The adjustment turret of claim 4, wherein a joint between said first housing portion and said second housing portion is sealed.

6. The adjustment turret of claim 4, wherein one of said first housing portion and said second housing portion rotatably supports one of said cap and said adjustment member and the other of said first housing portion and said second housing portion rotatably supports the other of said cap and said adjustment member.

7. The adjustment turret of claim 1, wherein said adjustment member is a threaded shaft having threads formed at an angle relative to a longitudinal axis of said housing to cause axial movement of said adjustment member relative to said housing when said adjustment member is rotated.

8. The adjustment turret of claim 7, wherein said indicia are formed at substantially the same angle relative to said longitudinal axis as said threads.

9. The adjustment turret of claim 1, wherein said sight glass includes a lens operable to magnify said indicia.

10. The adjustment turret of claim 1, wherein said adjustment member is a threaded shaft having threads formed at an angle relative to a longitudinal axis of said housing to cause axial movement of said adjustment member relative to said housing when said adjustment member is rotated.

11. The adjustment turret of claim 10, wherein said threaded shaft is a two-piece threaded shaft having a first end fixed for movement with said cap and a second end rotatably supported by said housing.

12. The adjustment turret of claim 10, wherein said threaded shaft is a two-piece threaded shaft having a first end fixed for movement with said cap and a second end threadably attached to said housing.

13. An adjustment turret for an optical sight, the adjustment turret comprising:

a housing;

an adjustment member rotatably supported by said housing, said adjustment member operable to adjust a characteristic of the optical sight when moved relative to said housing, wherein said adjustment member is a threaded shaft having threads formed at an angle relative to a longitudinal axis of said housing to cause axial movement of said adjustment member relative to said housing when said adjustment member is rotated; and a cap extending from said housing and movable between an engaged state fixing said cap for rotation with said adjustment member and a disengaged state permitting relative rotation between said cap and said adjustment member, said cap rotatable relative to said housing in said disengaged state and said engaged state, wherein said threaded shaft is a two-piece threaded shaft having a first end fixed for movement with said cap and a second end threadably attached to said housing.

14. The adjustment turret of claim 13, wherein said cap includes a first series of splines and said adjustment member includes a second series of splines, said first series of splines are engaged with said second series of splines when said cap is in said engaged state and are disengaged from said second series of splines when said cap is in said disengaged state.

15. The adjustment turret of claim 13, wherein said housing includes a first housing portion and a second housing portion, said first housing portion cooperating with said second housing portion to define an inner volume that receives said adjustment member.

16. The adjustment turret of claim 15, wherein a joint between said first housing portion and said second housing portion is sealed.

17. The adjustment turret of claim 15, wherein one of said first housing portion and said second housing portion rotatably supports one of said cap and said adjustment member and the other of said first housing portion and said second housing portion rotatably supports the other of said cap and said adjustment member.

18. The adjustment turret of claim 13, further comprising a sight glass supported by said housing, said sight glass providing visual access to indicia fixed for rotation with said adjustment member.

19. The adjustment turret of claim 18, wherein said adjustment member is a threaded shaft having threads formed at an angle relative to a longitudinal axis of said housing to cause axial movement of said adjustment member relative to said housing when said adjustment member is rotated.

20. The adjustment turret of claim 19, wherein said indicia are formed at substantially the same angle relative to said longitudinal axis as said threads.

21. The adjustment turret of claim 18, further comprising an illumination device operable to illuminate said indicia.

22. The adjustment turret of claim 18, wherein said sight glass includes a lens operable to magnify said indicia.

23. The adjustment turret of claim 13, wherein said threaded shaft is a two-piece threaded shaft having a first end fixed for movement with said cap and a second end rotatably supported by said housing.

24. An adjustment turret for an optical sight, the adjustment turret comprising:

a housing;

an adjustment member having a head and a threaded shaft and being rotatably supported by said housing, said adjustment member operable to adjust a characteristic of said optical sight when moved relative to said housing;

a cap extending from said housing and movable between an engaged state fixing said cap for rotation with said adjustment member and a disengaged state permitting relative rotation between said cap and said adjustment member, said cap moveable from said disengaged state to said engaged state in a direction away from said housing, wherein when in an engaged state, a portion of said cap contacts said head of said adjustment member;

wherein said threaded shaft of said adjustment member has threads formed at an angle relative to a longitudinal axis of said housing to cause axial movement of said adjustment member relative to said housing when said adjustment member is rotated; and wherein said threaded shaft is a two-piece threaded shaft having a first end fixed for movement with said cap and a second end threadably attached to said housing.

25. The adjustment turret of claim 24, wherein said cap is rotatable relative to said housing in said engaged state and said disengaged state.

26. The adjustment turret of claim 24, wherein said cap includes a first series of splines and said adjustment member includes a second series of splines, said first series of splines are engaged with said second series of splines when said cap is in said engaged state and are disengaged from said second series of splines when said cap is in said disengaged state.

27. The adjustment turret of claim 24, wherein said housing includes a first housing portion and a second housing portion, said first housing portion cooperating with said second housing portion to define an inner volume that receives said adjustment member.

28. The adjustment turret of claim 27, wherein a joint between said first housing portion and said second housing portion is sealed.

29. The adjustment turret of claim 27, wherein one of said first housing portion and said second housing portion rotatably supports one of said cap and said adjustment member and the other of said first housing portion and said second housing portion rotatably supports the other of said cap and said adjustment member.

30. The adjustment turret of claim 24, further comprising a sight glass supported by said housing, said sight glass providing visual access to indicia fixed for rotation with said adjustment member.

31. The adjustment turret of claim 24, wherein said indicia are formed at substantially the same angle relative to said longitudinal axis as said threads.

32. The adjustment turret of claim 30, further comprising an illumination device operable to illuminate said indicia.

33. The adjustment turret of claim 30, wherein said sight glass includes a lens operable to magnify said indicia.

* * * * *